US008562101B2

(12) United States Patent
Calamita et al.

(10) Patent No.: US 8,562,101 B2
(45) Date of Patent: Oct. 22, 2013

(54) METHOD AND SYSTEM FOR CORRECTING MEDIA SHIFT DURING IDENTIFICATION OF PRINTHEAD ROLL

(75) Inventors: James P. Calamita, Spencerport, NY (US); Patricia J. Donaldson, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 114 days.

(21) Appl. No.: 13/330,213

(22) Filed: Dec. 19, 2011

(65) Prior Publication Data

US 2013/0155140 A1 Jun. 20, 2013

(51) Int. Cl.

| | |
|---|---|
| ***B41J 29/393*** | (2006.01) |
| ***B41J 2/015*** | (2006.01) |
| ***B41J 29/38*** | (2006.01) |
| ***B41J 2/205*** | (2006.01) |

(52) U.S. Cl.

USPC ..... 347/19; 347/20; 347/5; 347/14; 347/15

(58) Field of Classification Search

USPC ..... 347/5, 14–15, 19–20

See application file for complete search history.

(56) References Cited

U.S. PATENT DOCUMENTS

| | | | | |
|---|---|---|---|---|
| 6,213,580 | B1 | 4/2001 | Segerstrom et al. | |
| 7,309,118 | B2 | 12/2007 | Mizes et al. | |
| 7,798,587 | B2 * | 9/2010 | Mizes et al. | 347/8 |
| 7,837,290 | B2 | 11/2010 | Mizes et al. | |
| 8,104,861 | B2 * | 1/2012 | Saettel et al. | 347/19 |
| 2005/0179710 | A1 | 8/2005 | Tatsuta et al. | |
| 2006/0114283 | A1 | 6/2006 | Mizes et al. | |
| 2006/0132526 | A1 * | 6/2006 | Donovan | 347/19 |
| 2008/0062219 | A1 | 3/2008 | Mizes et al. | |
| 2010/0245455 | A1 | 9/2010 | Mizes et al. | |

* cited by examiner

*Primary Examiner* — Stephen Meier
*Assistant Examiner* — Sarah Al Hashimi
(74) *Attorney, Agent, or Firm* — Maginot, Moore & Beck, LLP

(57) ABSTRACT

A method for aligning a printhead to compensate for printhead roll when an image receiving member moves laterally during printing has been developed. The method includes generating at different times a plurality of marks in a process direction with different inkjets in a printhead and identifying relationships between marks in each plurality. Lateral motion is thereby detected and removed from the analysis identifying the magnitude of the roll corresponding to the locations of the marks in the pluralities of marks.

6 Claims, 8 Drawing Sheets

METHOD AND SYSTEM FOR CORRECTING MEDIA SHIFT DURING IDENTIFICATION OF PRINTHEAD ROLL

TECHNICAL FIELD

The present disclosure relates to imaging devices that utilize inkjet printheads to form images on media, and, in particular, to the alignment of such printheads in printers.

BACKGROUND

Ink jet printing involves ejecting ink droplets from orifices in a printhead onto an image receiving member to form an ink image. Inkjet printers commonly utilize either direct printing or offset printing architecture. In a typical direct printing system, ink is ejected from the inkjets in the printhead directly onto the final substrate. In an offset printing system, the printhead jets the ink onto an intermediate transfer surface, such as a liquid layer on a drum. The final substrate is then brought into contact with the intermediate transfer surface and the ink image is transferred to the substrate before being fused or fixed to the substrate.

Alignment among multiple printheads may be expressed as the position of one printhead relative to the image receiving member, such as a media substrate or intermediate transfer surface, or another printhead within a coordinate system of multiple axes. For purposes of discussion, the terms "cross-process direction" and "X-axis direction" refer to a direction or axis perpendicular to the direction of travel of an image receiving member past a printhead within the plane of the image receiving member. The terms "process direction" and "Y-axis direction" refer to a direction or axis parallel to the direction of an the image receiving member, the term "Z-axis" refers to an axis perpendicular to the X-Y axis plane.

One particular type of alignment parameter is printhead roll. As used herein, printhead roll refers to clockwise or counterclockwise rotation of a printhead about an axis normal to the image receiving member, i.e., the Z-axis. Printhead roll may result from mechanical vibrations and other sources of disturbances on the machine components that may alter printhead positions and/or angles with respect to the image receiving member. As a result of roll, the rows of nozzles may be arranged diagonally with respect to the process direction movement of the image receiving member. This roll may cause horizontal lines, image edges, and the like to be skewed relative to the image receiving member. If the printer controls for this skew using timing adjustments, roll can increase the magnitude of the adjustments required, potentially causing the system to run out of actuation latitude. Depending upon the arrangement of nozzles in the printhead, roll error may also produce cross-process direction uniformity defects in image areas of uniform ink density.

Various methods are known to measure printhead roll and to calibrate the printhead to reduce or eliminate the effects of printhead roll on images generated by the printhead. The known methods include printing selected marks or test patterns onto the image receiving member from the printhead to identify printhead roll. In some imaging systems, the image receiving member moves in the cross-process direction while the printhead generates the test pattern. Even comparatively small movements in the image receiving member can result in errors in printed test patterns that reduce the effectiveness of known methods for detecting printhead roll. Thus, improvements to printhead measurement and calibration procedures for detecting printhead roll are desirable.

SUMMARY

In one embodiment, a method of aligning a printhead has been developed. The method includes ejecting a first plurality of ink drops from a first inkjet in the printhead to form a first plurality of marks arranged in a process direction on an image receiving member, ejecting a second plurality of ink drops from a second inkjet in the printhead to form a second plurality of marks arranged in the process direction on the image receiving member, the ejection of the second plurality of ink drops beginning at a time that is later than a time at which the ejection of the first plurality of ink drops began, generating image data corresponding to the first plurality of marks and the second plurality of marks, identifying with reference to the image data a cross-process location of each mark in the first plurality of marks and each mark in the second plurality of marks on the image receiving member, identifying a first relationship between a relative cross-process location of each mark in the first plurality of marks with reference to a first mark in the first plurality of marks and a time at which each mark in the first plurality of marks was formed, identifying a second relationship between a relative cross-process location of each mark in the second plurality of marks with reference to a first mark in the second plurality of marks and a time at which each mark in the second plurality of marks was formed, the first mark in the second relationship having a relative cross-process direction location that corresponds to a relative cross-process direction location in the first relationship at a time at which the first mark in the second plurality of marks was formed on the image receiving member, generating an estimate of a cross-process direction offset of the image receiving member over time with reference to the first relationship and second relationship, identifying a relative cross-process direction offset of the image receiving member corresponding to each of the first plurality and second plurality of marks with reference to the estimate of the cross-process direction offset of the image receiving member over time and a time at which each mark was formed on the image receiving member, generating a corrected cross-process direction location for each mark in the first plurality of marks and the second plurality of marks with reference to the identified cross-process location of each mark and the identified cross-process direction offset of the image receiving member corresponding to each mark, identifying with reference to the corrected cross-process direction location of each mark in the first plurality of marks and second plurality of marks a plurality of cross-process direction distances between the first plurality of marks formed by the first inkjet and the second plurality of marks formed by the second inkjet, and identifying a difference between an angular orientation of the printhead and the cross-process direction with reference to the plurality of identified cross-process direction distances.

In another embodiment, a method of operating a printer has been developed. The method includes generating with an optical sensor in the printer image data corresponding to an array of marks formed a plurality of inkjets in the printhead on an image receiving member that moves in a process direction, the array of marks including a plurality of series of marks arranged in a cross-process direction on the image receiving member, each series of marks being arranged in the process direction on the image receiving member and being formed by one inkjet in the plurality of inkjets that each form a first mark in the corresponding series of marks at a different time, identifying a relationship between relative cross-process locations of successive marks in each series of marks in the plurality of series of marks in the image data with reference to predetermined times at which each mark in each series of marks in the plurality of series of marks was formed, and generating an estimate of a cross-process direction movement of the image receiving member over time with reference to the identified relationships between the marks in each series of marks in the plurality of series of marks in the image data.

In another embodiment, an inkjet printer has been developed. The printer includes a media transport configured to move a media web through a print zone in a process direction, a printhead positioned in the print zone and having a plurality of inkjets configured to eject ink drops onto the media web, a plurality of optical detectors configured in a cross-process direction across the image receiving member, each optical detector in the plurality of optical detectors being configured to detect light reflected from the image receiving member, and a controller operatively connected to the printhead and the plurality of optical detectors. The controller is configured to operate the plurality of inkjets in the printhead to form an array of marks on the media web, each inkjet in the plurality of inkjets forming one series of marks in the array of marks extending in the process direction and the array of marks including a plurality of series of marks extending in the cross-process direction, each inkjet in the plurality of inkjets commencing formation of a corresponding series of marks in the plurality of series of marks at a time that is different from a time at which at least one other inkjet commences formation of another one of the plurality of series of marks, generate image data corresponding to the array of marks with the plurality of optical detectors, identify a cross-process direction location of each mark in the array of marks with reference to the image data, identify a relationship between relative cross-process locations of successive marks in each series of marks in the plurality of series of marks in the image data with reference to predetermined times at which each mark in each series of marks was formed, generate an estimate of a cross-process direction movement of the media web over time with reference to the relationship for each series of marks in the plurality of series of marks in the image data, generate a corrected cross-process direction location for each of the series of marks in the array of marks with reference to the identified cross-process location of each mark and an estimated cross-process direction offset of the media web at a time at which each mark was formed with reference to the estimate of cross-process direction movement of the media web, identify with reference to the corrected cross-process direction location of each mark in the array of marks a cross-process direction distance between a first series of marks and at least one other series of marks, and identify a difference between an angular orientation of the printhead and the cross-process direction with reference to the identified cross-process direction distance.

BRIEF DESCRIPTION OF THE DRAWINGS

The foregoing aspects and other features of a printer that detects and compensates for roll in one or more printheads in the printer are explained in the following description, taken in connection with the accompanying drawings.

DETAILED DESCRIPTION

Figure 1A:
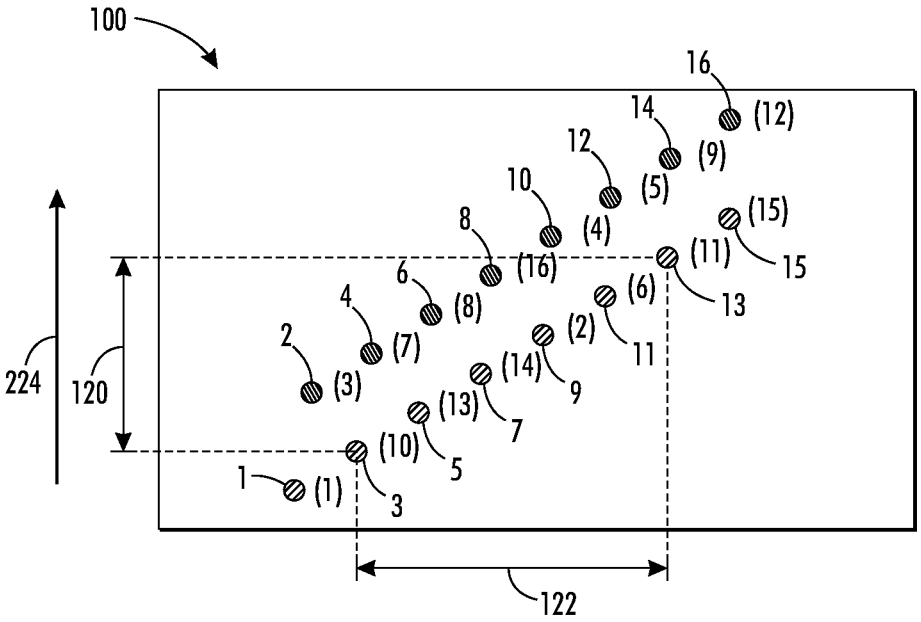
FIG. 1A is a view of a printhead with a plurality of inkjets aligned with a cross-process direction.

For a general understanding of the present embodiments, reference is made to the drawings. In the drawings, like reference numerals have been used throughout to designate like elements. As used herein, the terms "printer" generally refer to an apparatus that applies an ink image to print media and may encompass any apparatus, such as a digital copier, bookmaking machine, facsimile machine, multi-function machine, etc., which performs a print outputting function for any purpose. As used in this document, "ink" refers to a colorant that is liquid when applied to an image receiving member. For example, ink may be aqueous ink, ink emulsions, melted phase change ink, and gel ink that has been heated to a temperature that enables the ink to be liquid for application or ejection onto an image receiving member and then return to a gelatinous state. "Print media" can be a physical sheet of paper, plastic, or other suitable physical substrate suitable for receiving ink images, whether precut or web fed. A printer may include a variety of other components, such as finishers, paper feeders, and the like, and may be embodied as a copier, printer, or a multifunction machine. An ink image generally may include information in electronic form, which is to be rendered on print media by a marking engine and may include text, graphics, pictures, and the like.

The term "printhead" as used herein refers to a component in the printer that is configured to eject ink drops onto the image receiving member. A typical printhead includes a plurality of inkjets that are configured to eject ink drops of one or more ink colors onto the image receiving member. The inkjets are arranged in an array of one or more rows and columns. In some embodiments, the inkjets are arranged in staggered diagonal rows across a face of the printhead. Various printer embodiments include one or more printheads that form ink images on the image receiving member.

As used herein, the term "dash" refers to a mark formed on an image receiving member that includes a series of ink drops extending in the process direction formed by a single inkjet in a printhead. A dash can be formed from ink drops located in adjacent pixels in the process direction on the image receiving member and can include a pattern of on/off adjacent pixels in the process direction. As used herein, the term "pixel" refers to a location on the image receiving member that receives an individual ink drop from an inkjet. Locations on the image receiving member can be identified with a grid-like pattern of pixels extending in the process direction and cross-process direction on the image receiving member. As used herein, the term "test pattern" refers to a predetermined arrangement of markings formed on an image receiving member by one or more printheads in the printer. In some embodiments, a test pattern includes a predetermined arrangement of a plurality of dashes formed by some or all of the inkjets in the printheads arranged in the print zone.

FIG. 1A depicts a printhead 100 including a plurality of inkjets exemplified by inkjets 1-16. The inkjets are formed in a plurality of diagonal rows, with FIG. 1 depicting a group of sixteen inkjets in the printhead 100 with one diagonal row including even-numbered inkjets 2, 4, 6, 8, 10, 12, 14, and 16 and another diagonal row including odd numbered inkjets 1, 3, 5, 7, 9, 11, 13, and 15. In one configuration, each inkjet in the printhead 100 is configured to eject ink having a single color onto an image receiving member. In another configuration, the printhead 100 is a multi-color printhead where selected groups of inkjets emit ink drops having different colors of ink. In one configuration of a multi-color printhead, the even-numbered inkjets 2-16 eject ink having one color and the odd numbered inkjets 1-15 eject ink having a different color. While printhead 100 is depicted with sixteen inkjets for illustrative purposes, alternative printheads include hundreds or thousands of inkjets. In one embodiment, a printhead includes 880 inkjets and in one operating mode groups of sixteen inkjets in the printhead similar to the configuration of FIG. 1A form test patterns on the image receiving member. The inkjets 1-16 in the printhead 100 are operated in a predetermined order to form a test pattern with a plurality of dashes on an image receiving member.

In the printhead 100, the inkjets arranged along each diagonal are separated from each other by a predetermined distance in the process direction 224 and another predetermined distance in the cross-process direction. For example, inkjets 3 and 13 are separated by a predetermined process direction distance 120, and cross-process direction distance 122. The structure of the printhead 100 and density of the inkjets in the printhead determine the cross-process and process direction distances between the inkjets. In the embodiment of the printhead 100, all of the inkjets are formed with uniform separation in the cross-process direction 122 between the inkjets.

Figure 1B:
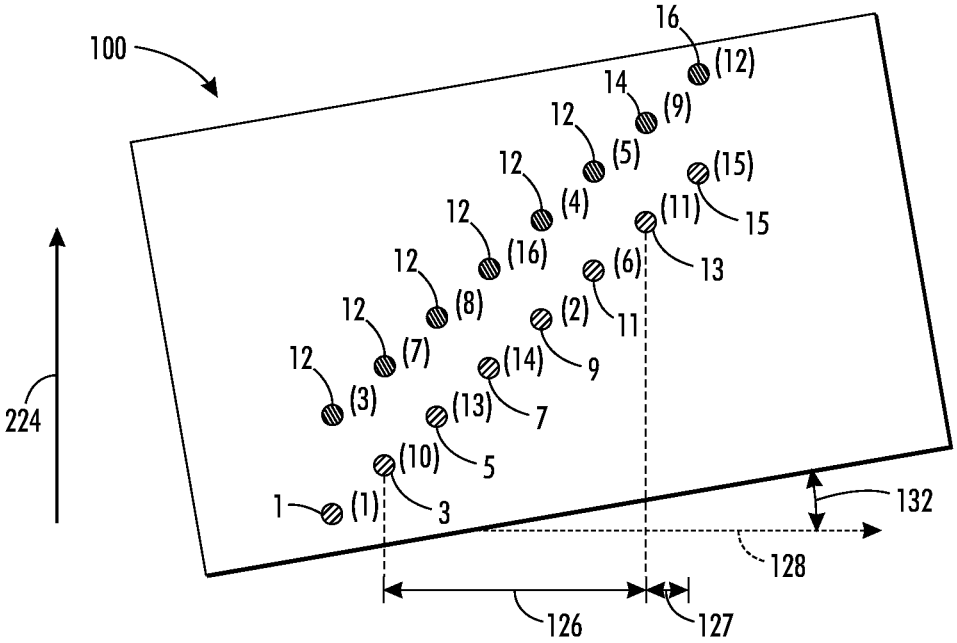
FIG. 1B is a view of the printhead of FIG. 1A with an exaggerated angular offset from the cross-process direction.

FIG. 1B depicts the printhead 100 of FIG. 1A with an angular orientation that alters the distance between inkjets in the cross-process direction. In the configuration of FIG. 1B, the printhead 100 is said to have a printhead roll. The printhead roll is depicted by an angle of rotation 132 between the printhead 100 and the cross-process direction 128. The magnitude of the angle 132 is typically measured in degrees or radians. The direction of the angle 132 refers to whether the printhead 100 rolls in a clockwise or counter-clockwise direction, which can also be expressed as positive or negative values of the sign of the angle 132.

In FIG. 1B, the printhead 100 rotates in a counter-clockwise direction. The cross-process direction distance between the inkjets 3 and 13 in the orientation of FIG. 1B is depicted by distance 126. A second distance 127 depicts a difference between the cross-process distance 126 and the nominal cross-process distance 122 between the inkjets 3 and 13 from FIG. 1A where there printhead 100 is aligned in the cross-process direction. In the configuration of FIG. 1B, the cross-process distance 126 is smaller than the predetermined cross-process distance 122 of the aligned printhead. In orientations where the printhead 100 experiences roll in a clockwise direction, the cross-process distance between corresponding inkjets is larger than the predetermined distance 122. Printhead roll affects the cross-process direction distance between any two inkjets in the printhead 100. As described in more detail below, both the magnitude and direction of the printhead roll are identified with reference to the measured cross-process distance between two or more inkjets compared to the predetermined cross-process distance between the inkjets when the printhead is aligned with the cross-process direction.

The magnitude of the printhead roll depicted in FIG. 1B is exaggerated for illustrative purposes. In a typical printer embodiment, the printhead roll is on the order of approximately 0.001 to 0.01 radians. The systems and method described herein are suitable for identifying and correcting printhead roll over a wide range of angular displacements and printhead resolutions.

Figure 2:
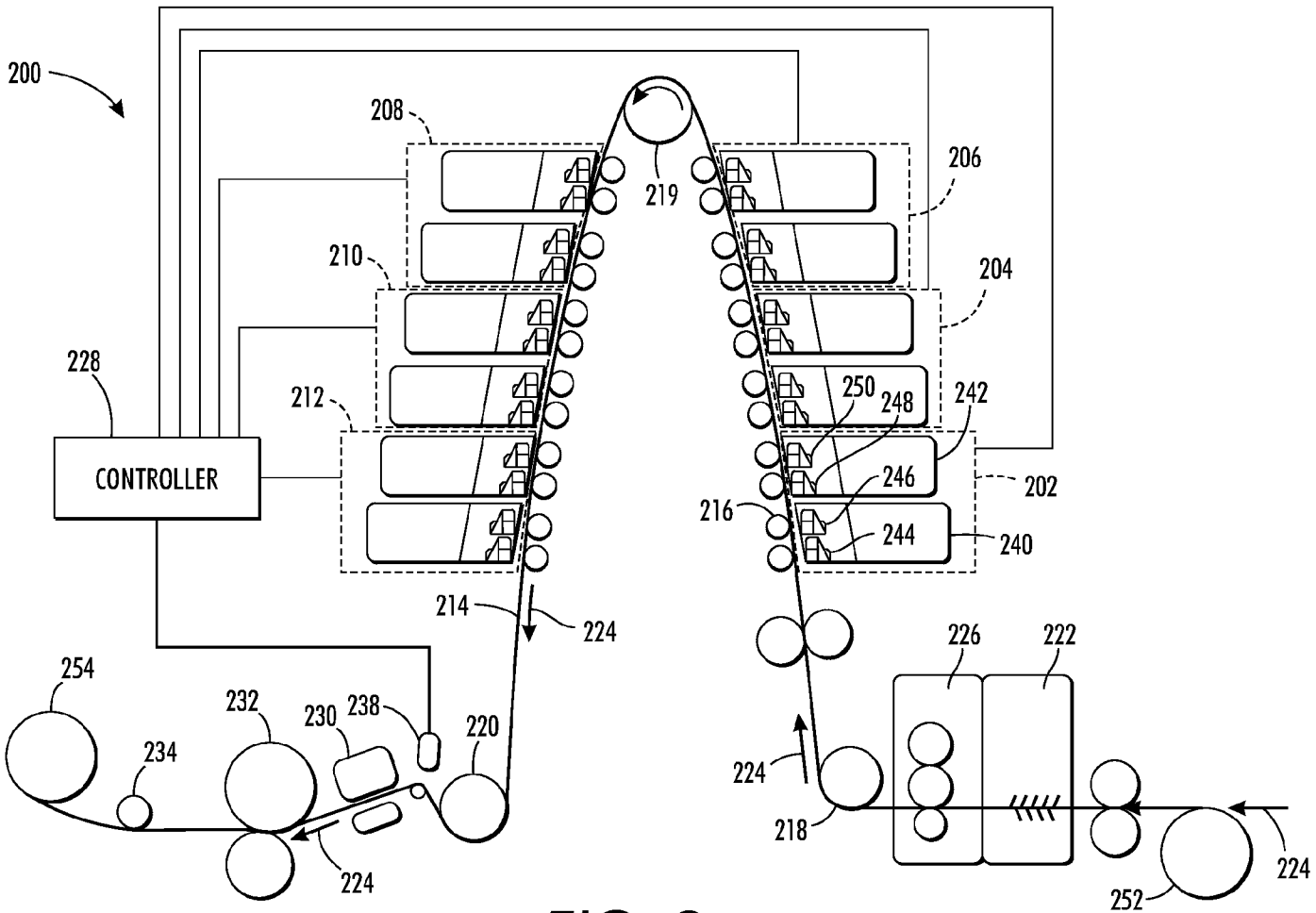
FIG. 2 is a schematic view of a direct printer that includes a plurality of printheads.

FIG. 2 depicts an exemplary embodiment of a printer 200 that is configured to identify and correct printhead roll. Printer 200 is a continuous web printer that includes six print modules 202, 204, 206, 208, 210, and 212; a media path configured to accept a print medium 214, and a controller 228. The print modules 202, 204, 206, 208, 210, and 212 are positioned sequentially along the media path and form a print zone in which ink images are formed on a print medium 214 as the print medium 214 moves past the print modules in a process direction 224. In the embodiment of the printer 200, the print medium 214 is an elongated medium, such as a roll of paper, which unrolls through the media path in a web-like configuration and is commonly known as a media web. The print modules 202-212 print ink drops directly on the media web 214 as the media web 214 moves through the print zone, and the media web is the image receiving member in the embodiment of printer 200.

In printer 200, each print module 202, 204, 206, 208, 210, and 212 in this embodiment provides an ink of a different color. In all other respects, the print modules 202-212 are substantially identical. Print module 202 includes two print sub-modules 240 and 242. Print sub-module 240 includes two print units 244 and 246. The print units 244 and 246 each include an array of printheads that may be arranged in a staggered configuration across the width of both the first section of the web media and second section of web media. Each of the printheads includes a plurality of inkjets in a configuration similar to the printhead 100 depicted in FIG. 1. In a typical embodiment, print unit 244 has four printheads and print unit 246 has three printheads. The printheads in print units 244 and 246 are positioned in a staggered arrangement to enable the printheads in both units to emit ink drops in a continuous line across the width of media path at a predetermined resolution.

Print sub-module 242 is configured in a substantially identical manner to sub-module 240, but the printheads in sub-module 242 are offset by one-half the distance between the inkjets in the cross-process direction from the printheads in sub-module 240. The arrangement of sub-modules 240 and 242 enables a doubling of linear resolution for images formed on the media web 214. For example, if each of the sub-modules 240 and 242 ejects ink drops at a resolution of 300 drops per inch, the combination of sub-modules 240 and 242 ejects ink drops at a resolution of 600 drops per inch.

The printer 200 includes an optical sensor 238 that generates image data corresponding to light reflected from the media web 214 after the media web 214 has passed through the print zone. The optical sensor 238 is configured to detect, for example, the location, intensity, and/or location of ink drops jetted onto the receiving member by the inkjets of the printhead assembly. The optical sensor 238 includes an array of optical detectors mounted to a bar or other longitudinal structure that extends across the width of the media web 214 in the cross-process direction.

In one embodiment in which the media web 214 is approximately twenty inches wide in the cross process direction and the print modules 202-212 print at a resolution of 600 dpi in the cross process direction, over 12,000 optical detectors are arrayed in a single row along the bar to generate a single scanline across the imaging member. The optical detectors are configured in association with one or more light sources that direct light towards the surface of the image receiving member. The optical detectors are arranged in the optical sensor 238 in a predetermined configuration in the cross-process direction. Consequently, the cross-process location of light reflected from the media web 214 can be identified with reference to the optical detector that detects the reflected light. For example, if two optical detectors in the optical sensor 238 detect light reflected from two different ink drops on the media web 214, then the predetermined distance that separates the optical detectors in the optical sensor 238 corresponds to the cross-process distance between the two ink drops on the media web 214.

The optical detectors receive the light generated by the light sources after the light is reflected from the image receiving member. The magnitude of the electrical signal generated by an optical detector in response to light being reflected by the bare surface of the image receiving member is larger than the magnitude of a signal generated in response to light reflected from a drop of ink on the image receiving member. This difference in the magnitude of the generated signal can be used to identify the locations of ink drops on an image receiving member, such as a paper sheet, media web, or print drum. The magnitudes of the electrical signals generated by the optical detectors are converted to digital values by an appropriate analog/digital converter. The digital values are denoted as image data in this document and a processing device, such as controller 228 executing programmed instructions, analyzes the image data to identify location information about dashes formed by ink drops on the image receiving member.

During operation, the media web 214 moves through the media path in process direction 224. The media web 214 unrolls from a source roller 252 and passes through a brush cleaner 222 and a contact roller 226 prior to entering the print zone. The media path moves the media web 214 through the print zone past the print modules 202-212 with various rollers including a pre-heater roller 218, backer rollers, exemplified by backer roller 216, apex roller 219, and leveler roller 220. The media web 214 then passes through a heater 230 and a spreader 232 after passing through the print zone. The media web passes an exit guide roller 234 and then winds onto a take-up roller 254. The media path including the rollers 216-220 depicted in FIG. 2 is exemplary of one media path configuration in a web printing system, but various different configurations also lead the web past different rollers and other components. Alternative embodiments use media path configurations that include a duplexing unit that enables the printer 200 to form ink images on both sides of the media web 214.

The media web 214 may experience oscillations in the cross-process direction as the media web moves through the printer 200. During a printing operation, the web 214 oscillates on the apex roll 219 due to axial and/or radial run out of the apex roll 219. Run out refers to any deviation in the rotational motion of the apex roll 219 from a uniformly circular rotation about a longitudinal axis of the roller. Consequently, cross-process direction position of the web 214 changes as the media web 214 moves past the print modules 202-212. In one configuration, the media web oscillates in the cross-process direction with a frequency of approximately 8 Hz and a magnitude of 30 μm. The oscillations can reduce the accuracy of absolute location measurements made with reference to the image data generated by the optical sensor 238 because the optical sensor 238 remains stationary while the media web 214 oscillates.

Controller 228 is configured to control various subsystems, components and functions of printer 200. The controller 228 is operatively connected to each of the printheads in the print modules 202-212 to control ejection of ink from each of the print modules 202-212. The controller 228 is connected to each of the printhead roll actuators, and adjusts the roll of each printhead in a clockwise or counterclockwise direction by operating a corresponding actuator. The controller 228 is also connected to optical sensor 238 and the controller 228 receives digital image data that the optical sensor 238 generates from light reflected from the media web 214.

In various embodiments, controller 228 is implemented with general or specialized programmable processors that execute programmed instructions. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

Controller 228 is operatively coupled to the print modules 202-222 and controls the timing of ink drop ejection from the print modules 202-212 onto the media web 214. The controller 228 generates a plurality of electrical firing signals for the inkjets in each of the print modules 202-212. The controller 228 is configured to generate a predetermined sequence of firing signals for at least one of the printheads in the print modules 202-212 to generate test pattern ink marks on the media web 214. Various configurations of test patterns formed on the media web 214 enable the controller 228 to identify printhead roll of the printheads in the print modules 202-212.

Figure 3:
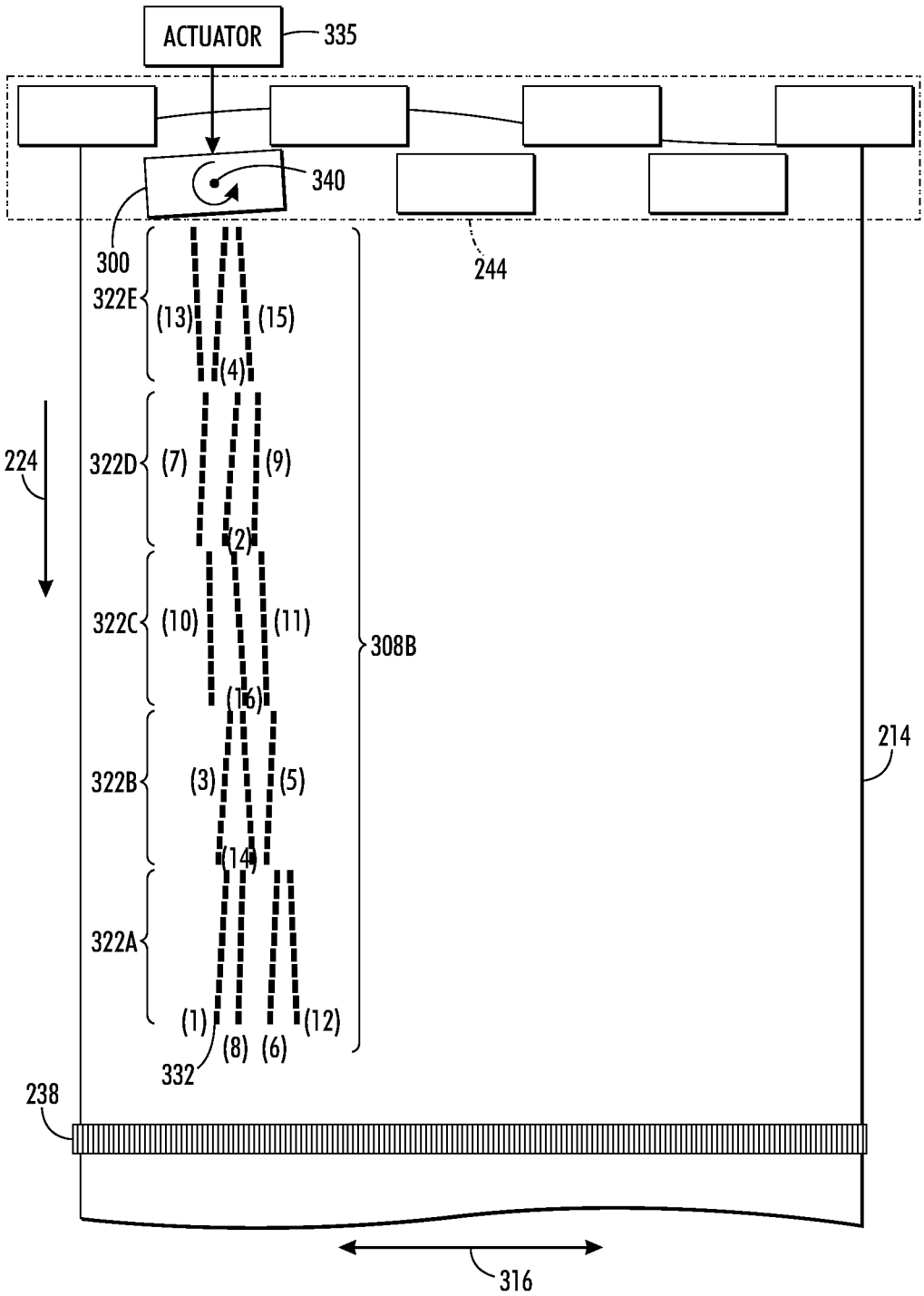
FIG. 3 is a depiction of a plurality of printheads in the direct printer of FIG. 1 including a test pattern formed by one printhead in the plurality of printheads.

FIG. 3 depicts the print units 244 in the printer 200 including one printhead 300 that experiences printhead roll. The printhead 300 is rotated in a counter-clockwise direction about an axis 340 that is perpendicular to the surface of the media web 214. Printhead 300 shares the same configuration as the printhead 100 and includes the arrangement of inkjets 1-16 depicted in FIG. 1A and FIG. 1B. FIG. 3 depicts a top view of the printhead 300 printing downward onto the media web 214. The controller 228 operates inkjets in the printhead 300 to form a test pattern 320 on the media web 214 as the media web 214 moves in the process direction 224.

The test pattern 320 includes five groups of dashes 322A-322E. Each series of dashes in the test pattern 320 is formed by one of the inkjets in the printhead 300. In the test pattern 320 each inkjet forms a series of ten dashes extending in the process direction 224, although alternative test patterns including a different number of dashes in each series of dashes can be used. In the exemplary configuration of FIG. 3, the group of dashes 322A includes dashes formed by four inkjets while the groups 322B-322E each include dashes formed by three inkjets. One alternative test pattern includes four groups of dashes that are each formed by four different inkjets. Various other test patterns can be used that provide sufficient spacing between the dashes to enable an optical sensor to detect and distinguish each of the separate dashes in the test pattern.

Inkjets that form each group of dashes 322A-322E are operated at different times to form the dashes in a series of rows that are substantially parallel with the cross-process axis 316. Referring to both FIG. 1A, FIG. 1B, and FIG. 3, the inkjets 1-16 in the printhead 300 are arranged in a diagonal direction and operate at different times to form each group of dashes 322A-322E in the test pattern 320. The firing order of each of the inkjets 1-16 is depicted in parenthesized numbers in FIG. 1A and FIG. 1B. In the example of FIG. 3, the inkjets operate to form the test pattern 320 in the following order: 1, 9, 2, 10, 12, 11, 4, 6, 14, 3, 13, 16, 5, 7, 15, 8. During the time that each inkjet forms each series of dashes, at least one other inkjet also ejects ink drops onto the media web 214 to form part of another series of dashes. For example, after inkjet 1 begins forming a first series of dashes in the group of dashes 322A, inkjet 9 begins forming a series of dashes in the group of dashes 322D. Even though the two series of dashes are not in the same group of dashes, both of the inkjets 1 and 9 operate at approximately the same time while forming some of the dashes in each respective series of dashes. Inkjet 1 begins forming dashes before inkjet 9 begins forming dashes, and inkjet 9 ends forming dashes after inkjet 1 ends forming dashes. Similarly, inkjet 2 begins forming dashes after inkjet 9 has started forming dashes and ends after inkjet 9 finishes forming dashes, and the remaining inkjets continue printing in a similar manner. Thus, the time period during which each inkjet forms dashes on the media web 214 overlaps a portion of the time period during which at least one other inkjet in the printhead 300 forms dashes on the media web 214.

The media web 214 moves past the printhead 300 in the process direction 224 as the printhead 300 prints the test pattern 320. As described above, the media web 214 can oscillate in either direction along the cross-process direction axis 316 while the inkjets 1-16 in the printhead 300 print the dashes in the test pattern 320. The oscillation of the media web 214 produces an apparent offset of the cross-process location of dashes within each series of dashes and between different series of dashes that are printed on the media web 214. FIG. 3 depicts an exaggerated set of apparent cross-process direction offsets that the oscillation of the media web 214 induces in the test pattern 320. While the inkjets in the printhead 300 do not move appreciably during formation of the test pattern 320, the movement of the media web 214 changes the actual cross-process distance that separates each series of dashes in the test pattern. In one embodiment, the magnitude of the oscillation of the media web is approximately 30 μm. Since each series of dashes begins printing at a different time, the magnitude and direction of the cross-process error is often different for each series of dashes. In the example of FIG. 3, the first series of dashes (1) formed by inkjet 1 has an apparent drift to the right on the image receiving member 214 generated by movement of the image receiving member to the left on the cross-process axis 316. The twelfth series of dashes (12) formed by inkjet 16 begins printing a later time after the media web 214 has started to oscillate to the right on the cross-process axis 316, and the series of dashes (12) appears to drift to the left on the cross-process axis 316. The oscillation of the media web 214 introduces different offset errors to each series of dashes in the test pattern 320 that varies over time as the printhead 300 prints the test pattern 320. Since the identification of printhead roll is based on the difference between a predetermined cross-process direction distance between inkjets in the printhead and the measured cross-process direction distance between dashes formed by two or more inkjets in the printhead, the oscillation of the media web 214 can produce measurements of the distance differences that affect the accurate identification of the printhead roll.

Figure 4:
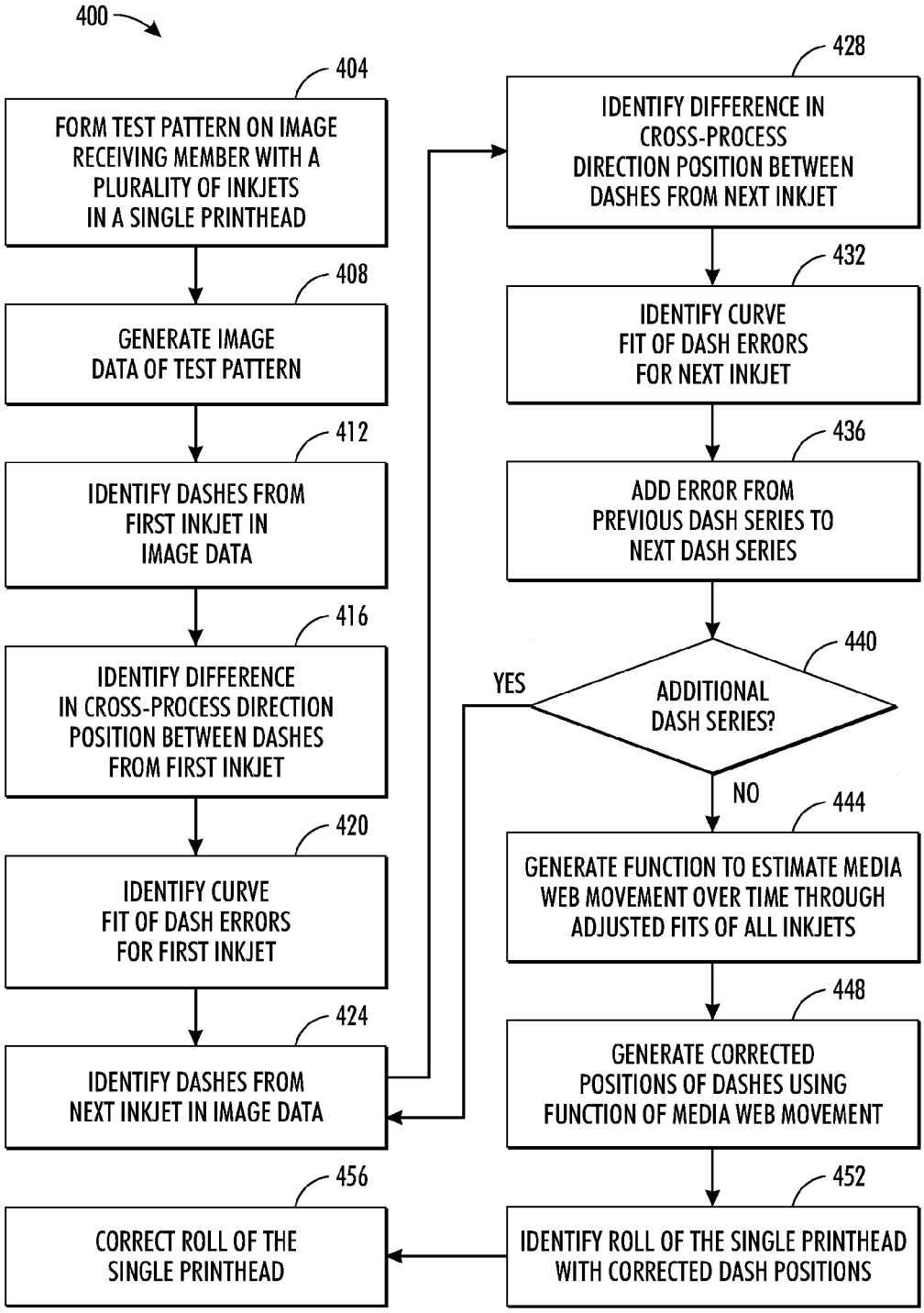
FIG. 4 is a block diagram of a process 400 for identifying and correcting cross-process direction motion of a media web and for identifying printhead roll.

FIG. 4 depicts a process 400 for identifying cross-process direction movement of the media web 214 using image data generated from the test pattern 320 and for correcting errors introduced by varying offsets of the oscillating media web 214 during identification of printhead roll. Process 400 is described with reference to the printer 200, printhead 300, and test pattern 320 depicted in FIG. 2-FIG. 3. Process 400 begins by operating a printhead to form a test pattern on an image receiving member with a plurality of inkjets in a single printhead (block 404). In the printer 200, one of the printheads, such as printhead 300, prints a test pattern, such as test pattern 320, on the media web 214. The printer then generates image data of the printed test pattern (block 408). In the printer 200, the optical sensor 328 generates a two-dimensional arrangement of image data corresponding to the test pattern 320 on the media web 214. The image data include pixel locations of each mark in the test pattern, including each of the dashes in the test pattern 320.

Process 400 identifies the series of dashes in the image data corresponding to the first inkjet in the printhead that started printing the test pattern (block 412). In the printhead 300, inkjet 1 begins printing the test pattern 320 with a first series of dashes (1) in the dash group 322A. Since each series of dashes in the test pattern is generated with a predetermined sequence of firing signals, the controller 228 in printer 200 associates the image data of each series of dashes in the test pattern 320 with the corresponding inkjet that formed the series of dashes, including the first inkjet. Process 400 also uses the time at which the first inkjet begins printing marks on the image receiving member as a reference for identifying the relative time at which the other inkjets in the printhead 300 begin forming marks in the test pattern.

Figure 5:
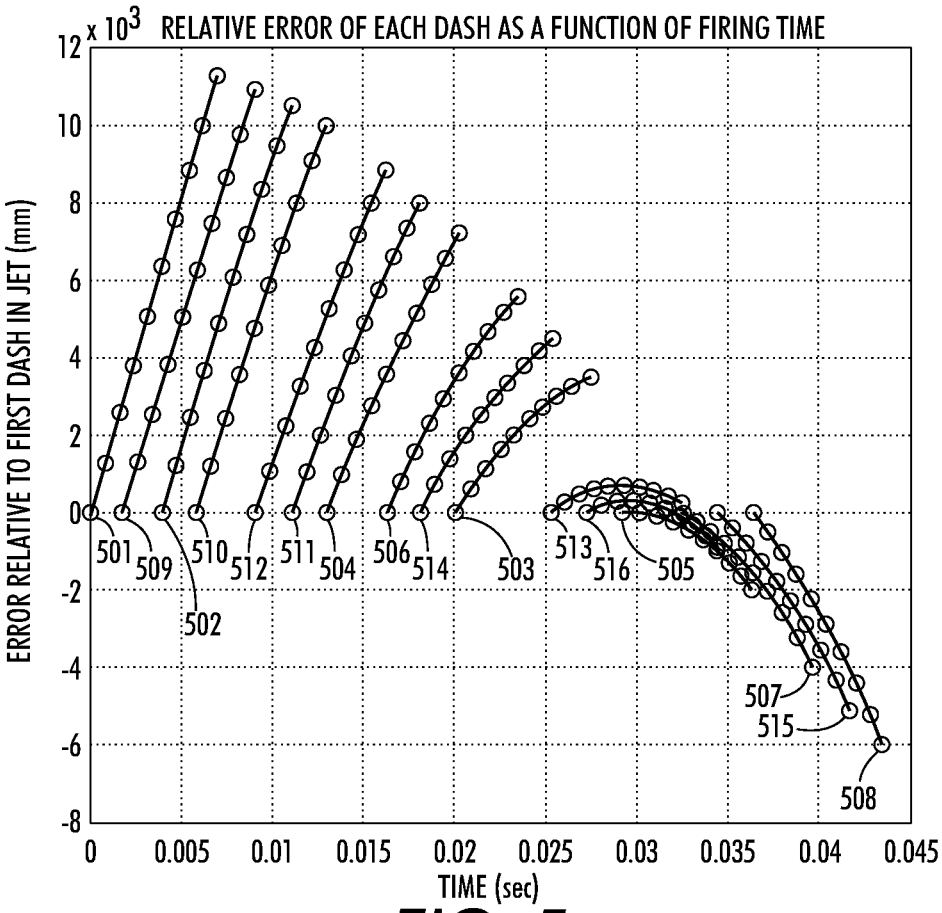
FIG. 5 is a diagram depicting relative cross-process direction offsets over time between dashes in a test pattern formed by a plurality of inkjets in a printhead.

Once the first series of dashes are identified in the image data, process 400 identifies differences in the cross-process direction locations of the dashes in the series of dashes formed by the first inkjet (block 416). In FIG. 3, the first inkjet 1 in the printhead 300 prints a series of dashes beginning with dash 332 and ending with dash 334. The controller 228 identifies the cross-process direction location of each dash with reference to the image data corresponding to the first dash 332. The relative change in cross-process location of the successive dashes in the first series of dashes corresponds to cross-process direction movement of the media web 214 during the time when the first inkjet formed the first series of dashes. Process 400 identifies a relationship through the relative cross-process direction locations of the dashes in the first series of dashes starting from the first dash 332 (block 420). In the printer 200, the controller 228 identifies the relationship as a curve fit through the identified cross-process direction location of each dash in the first series of dashes in the image data. In one embodiment, the curve fit is plotted as a function of relative error in the cross-process direction with reference to the first dash in the series with reference to time. FIG. 5 depicts the relative cross-process direction errors for each series of dashes in the test pattern 320, with relationship 501 indicating the cross-process error for the series of dashes formed by inkjet 1. The first dash 332 is plotted at time zero with zero relative cross-process direction error as a reference for each of the other dashes in the test pattern. Process 400 can identify various relationships through the dashes using one or more methods known to the art, including, but not limited to, linear regressions, linear and polynomial interpolations, and splines.

Process 400 continues in an iterative manner through image data corresponding to each series of dashes in the image data of the test pattern 320. Process 400 identifies a next series of dashes in the image data from the next inkjet to operate in the printhead when forming the test pattern 320 (block 424), identifies the difference in the cross-process direction locations of the dashes in the next series of dashes (block 428), and identifies a relationship of the relative error in the cross-process locations of the next series of dashes (block 432). Process 400 continues with the processing of blocks 424-432 being performed for the next series of dashes in substantially the same manner as blocks 412-420, respectively, were performed. In the test pattern 320, the next series of dashes refers to the dashes formed by the next inkjet to begin printing dashes on the image receiving member with reference to time. In the example of printhead 300, after the first inkjet 1 begins printing dashes, the next inkjet to begin printing is inkjet 9, which is then followed by inkjet 2, etc., as described above. FIG. 5 depicts the curve fits for each series of dashes in the test pattern 320 arranged according to the time at which each inkjet in the printhead 300 begins forming dashes in the test pattern 320. Curves 501, 509, 502, 510, 512, 511, 504, 506, 514, 503, 513, 516, 505, 507, 515, and 508 correspond to inkjets 1, 9, 2, 10, 12, 11, 4, 6, 14, 3, 13, 16, 5, 7, 15, and 8 in the printhead 300, respectively.

Figure 6:
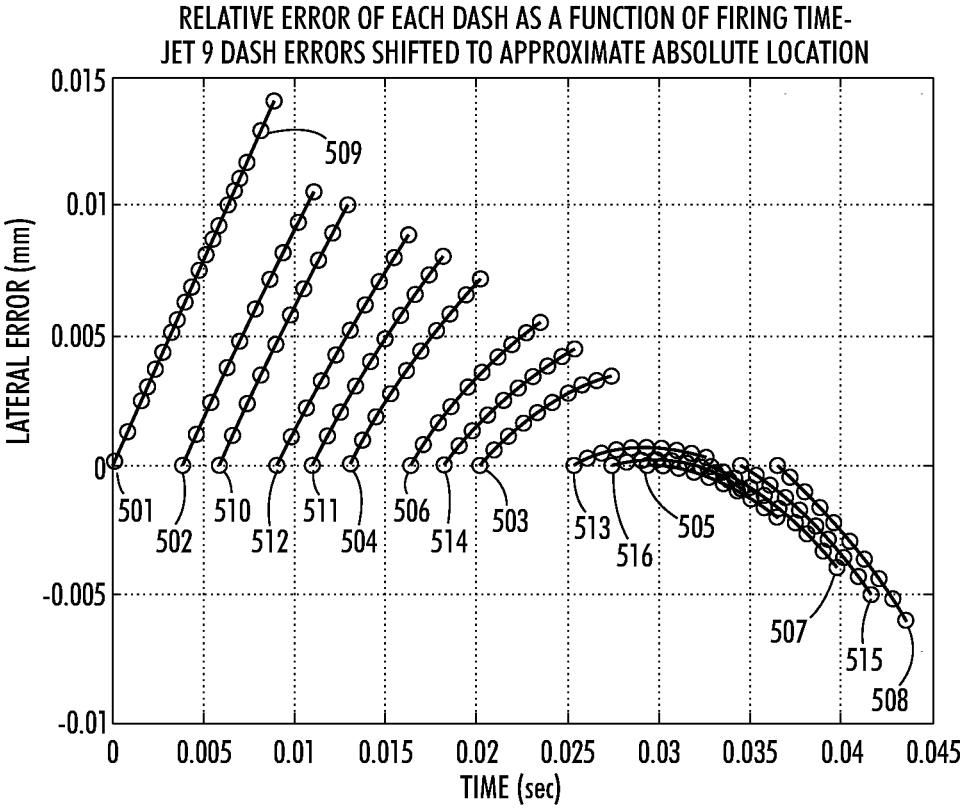
FIG. 6 is a diagram depicting one series of cross-process direction offsets from one inkjet that are arranged in series with the cross-process direction offsets of another inkjet where portions of the dashes formed by both inkjets are formed during a common time period.

After identifying the curve fit for the next series of dashes, process 400 moves the identified curve fit of the next series of dashes with reference to the relative cross-process direction error of the previous curve fit (block 436). For example, in FIG. 5 the curve fit 501 for the relative cross-process direction errors for dashes from inkjet 1 and the curve fit 509 for the relative cross-process direction errors for dashes from inkjet 9 are the previous and next curve fits, respectively. Inkjet 9 begins printing after inkjet 1 but before inkjet 1 completes printing the first series of dashes. As indicated in FIG. 5, some of the dashes formed by inkjet 9 are formed at approximately the same time as dashes formed by inkjet 1. Process 400 adds the relative cross-process error identified in the curve fit 501 to the curve fit 509 to adjust the relative cross-process direction error for dashes formed by inkjet 9 with reference to the dashes formed by inkjet 1. FIG. 6 depicts the curve 509 after the relative cross-process direction error from the curve fit 501 is added to the curve 509.

Process 400 continues in an iterative manner through blocks 424-436 for each additional dash series in the image data (block 440). For example, after performing blocks 424-436 for the series of dashes formed by inkjet 9, process 400 continues for the series of dashes formed by inkjet 2 using the curve fit 509 identified for the dashes formed by inkjet 9 as the previous series of dashes. The curve fit identified for each series of dashes is added to the sum of the identified cross-process direction errors for all of the preceding dash series.

After processing each series of dashes in the image data corresponding to the test pattern (block 440), process 400 identifies a function that estimates the varying offset of the media web in the cross-process direction during the time that the printer printed the test pattern on the media web (block 444). As used herein, the term "function" in the context of estimating the cross-process direction offset of the media web refers to a mathematical relationship that assigns a single value of a dependent variable to a range of values of an independent variable. In some embodiments of process 400, the independent variable in a function represents a range of time and the dependent variable represents the cross-process direction offset of the media web 214. The function generates a single value of the cross-process direction offset of the media web 214 for a given value of time. Other functions can include multiple dependent variables, each of which has a single value for a given value of an independent variable.

Figure 7:
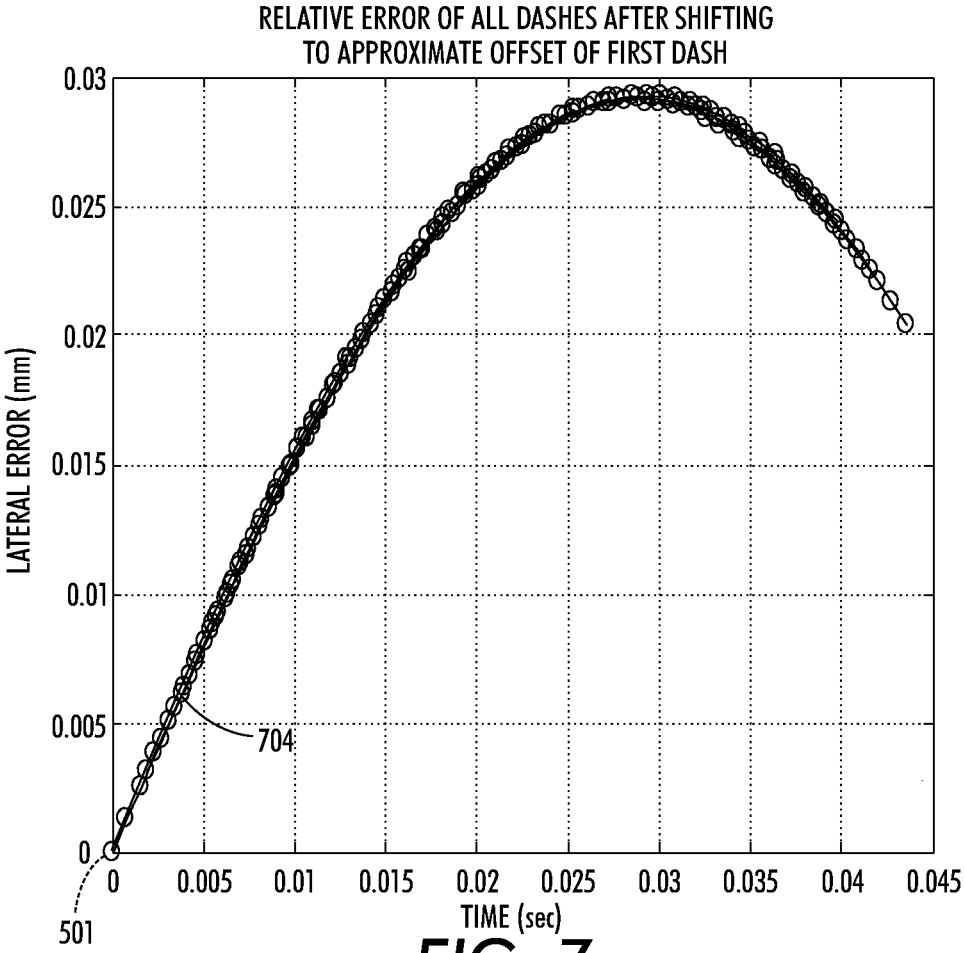
FIG. 7 is a diagram depicting the cross-process direction offsets from each inkjet in FIG. 5 arranged in a single series.

In one embodiment, process 400 identifies a polynomial function, such as a third-order polynomial function that estimates the cross-process direction motion of the media web over time. FIG. 7 depicts a curve 704 corresponding to a polynomial fit through the adjusted curves for each series of dashes beginning with the curve 501 corresponding to the image data of the dash series formed by inkjet 1. The curve 704 depicts the cross-process motion of the media web 214 over time as the test pattern 320 is printed on the media web 214. The exemplary polynomial curve 704 depicts a situation in which the media web 214 is moving in one cross-process direction as the printhead 300 begins to print the test pattern 320, and then reverses direction prior to completion of the test pattern. In various situations the cross-process direction offset of the media web may change at a comparatively constant rate, at an accelerating or decelerating rate, or reverse one or more times while the test pattern is printed.

Process 400 continues by generating corrected cross-process direction locations for one or more dashes in the image data of the test pattern 320 (block 448). Since each dash in the test pattern 320 is printed at a predetermined time, the correction process subtracts the relative error identified in the curve 704 from the cross-process direction location of the dash at the predetermined time when the dash was formed. Referring to the example of FIG. 7, if inkjet 1 ejects dash 334 formed by inkjet 1 in the test pattern 320 at a relative time of approximately 7.5 milliseconds, then the curve 704 estimates that the cross-process direction offset error of the media web is approximately 12 μm. The identified error of 12 μm is subtracted from the cross-process direction location of the dash 334 in the image data to generate a corrected location for the dash. The sign of the error indicates the direction in which the media web oscillates, with positive values indicating that the media web 214 oscillates in one direction on the cross-process axis 316, and negative values indicating that the media web 214 oscillates in the opposite direction. The first dash in the test pattern, which is dash 332 in the test pattern 320, is a reference dash and is not corrected. The cross-process direction locations of the remaining dashes in the test pattern 320 are corrected with reference to the first dash 332 using the curve 704. In one embodiment, process 400 identifies the cross-process direction location of an inkjet as the average cross-process direction location of the corrected series of dashes printed by the inkjet to reduce or eliminate the effect of media web oscillation.

While FIG. 7 depicts an estimated polynomial function that generates a curve to estimate the cross-process direction offset of the media web 214 with respect to time, other embodiments of process 400 produce estimates of the media web offset using non-polynomial functions. For example, a Fourier expansion generates a series of sinusoidal (sine and cosine) functions that estimate the periodic cross-process direction offset of the media web 214. The Fourier expansion generates an estimate of the oscillation of the media web 214 as a linear combination of a plurality of sinusoidal functions. Still other functions estimate the cross-process direction motion of the media web 214 in the frequency domain where the frequency of motion of the media web 214 is the independent variable in a function instead of time. Another estimation technique generates a spline fit through the cross-process direction position of the dashes in the test pattern with respect to time. In one embodiment of a spline fit, a least-squares cubic spline method generates a function that estimates the motion of the media web 214 with reference to the identified cross-process direction locations of the dashes in the image data. In one embodiment, the controller 228 in the printer 200 generates numerical estimates of the motion of the media web 214 with respect to time that correspond to one or more of the functions described above. The controller 228 corrects the identified cross-process direction locations for the dashes in the test pattern 320 with reference to the numerical estimates and the predetermined time of formation for each dash on the media web 214.

After generating the corrected cross-process direction locations for the dashes in the test pattern 320, process 400 identifies a magnitude and direction of the angular roll of the printhead 300 (block 452). One exemplary process for identifying printhead roll is described in commonly-assigned U.S. patent application Ser. No. 12/413,817, which is entitled "Method and System for Detecting Print Head Roll," and was filed on Mar. 30, 2009, the contents of which are expressly incorporated herein by reference. Process 400 identifies the magnitude and angular direction of the printhead roll from the average slope of the linear relationships generated for the measured errors in each printhead. The magnitude of the roll error angle θ is identified with the equation θ=arctan(m) where m is the identified average slope of the relationship between the measured cross-process direction error between two inkjets and the nominal process direction separation between the inkjets. Intuitively, the slope of the error line can be thought of as an angle of deviation from the expected slope of the diagonally arranged inkjets depicted in FIG. 1A. Various alternative methods for identifying printhead roll are also suitable for use with the corrected cross-process direction locations identified for the dashes in the test pattern. One method identifies the printhead roll with reference to a difference between an average cross-process direction spacing between dashes formed by a series of odd numbered jets and dashes formed by a next even numbered jet in the printhead. Another method identifies the printhead roll with reference to a difference between an average cross-process direction spacing between dashes formed by a series of even numbered jets and dashes formed by a next odd numbered jet in the printhead.

Figure 8:
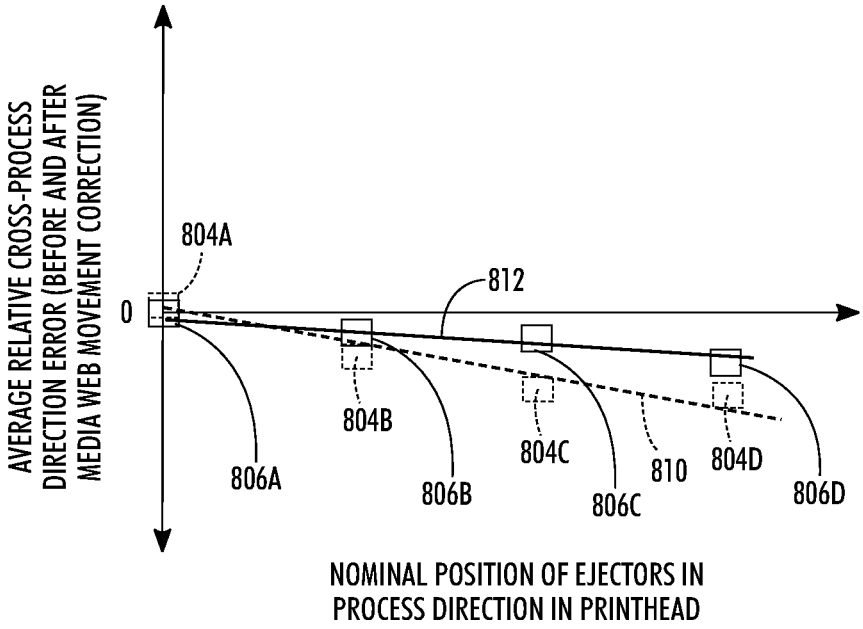
FIG. 8 is a diagram depicting cross-process direction error compared to the nominal position of inkjets in a printhead.

FIG. 8 depicts a plot of points 806A-806D corresponding to a plot of the identified locations of corrected cross-process locations of inkjets in the printhead 300 compared to the expected cross-process direction distance between the inkjets in a printhead that is aligned in the cross-process direction. FIG. 8 plots the deviation in cross-process direction distances between four inkjets, but alternative configurations use two or more inkjets to identify the printhead roll. Process 400 identifies the printhead roll from the slope m of the line 812. As depicted in dashed lines, the uncorrected apparent locations of the inkjets 804A-804D fit a second line 810 with a different slope m'. The difference between the slopes m and m' represents the error in printhead roll measurement introduced by the oscillation of the media web 214 while the test pattern is printed. Process 400 reduces or eliminates the effect of the media web oscillation to enable accurate identification of the printhead roll.

Process 400 identifies the direction of the rotation based on the direction of the average measured errors, which also corresponds to the sign of the average slope. In the example of FIG. 3, the printhead rolls in a counter-clockwise direction that reduces the measured cross-process distance between the selected inkjets, while a clockwise printhead roll increases the cross-process distance between the selected inkjets. Thus, the direction of errors, indicating either an increased or decreased distance between inkjets in the printhead, identifies the direction of the printhead roll. Since the sign of the slope of the linear error relationship 812 is generated based on the direction of the errors, a positive or negative sign of the slope indicates the direction of the printhead roll. The selected arrangement of inkjets in the printhead determines whether increases or decreases in the cross-process distance between inkjets indicate clockwise or counter-clockwise rotation of the printhead.

Process 400 optionally corrects the identified roll of the printhead (block 456). In the printer 200, an actuator 335 is operatively connected to the printhead 300 and selectively rotates the printhead 300 around the axis 340. In some embodiments, the actuator 335 is an electrical stepper motor. The controller 228 operates the actuator to rotate the printhead 300 in an opposite direction of the identified roll. For example, if the controller 228 identifies that the printhead 300 is rotated 0.005 radians in the counterclockwise direction during process 400, then the controller operates the actuator 335 to rotate the printhead by 0.005 radians in the clockwise direction to correct the roll.

During operation, the printer 200 can perform process 400 periodically to identify and correct for printhead roll in one or more printheads in the print zone. In some configurations, the printer 200 performs process 400 for different printheads in the print zone concurrently, where each printhead prints a test pattern on a different area of the media web 214.

While process 400 is directed to identification and correction of printhead roll, the estimation of media web oscillation can be used to monitor the operation of various components in the printer as well. For example, the magnitude and frequency of the oscillation of the media web 214 provides an indication of the degree of run out in the apex roller 219. In one embodiment, process 400 identifies the frequency and magnitude of the periodic motion of the rollers with a power spectral density (PSD) function in the frequency domain.

The controller operating the printer identifies whether the magnitude or frequency of the identified oscillation exceeds predetermined operating parameters for the printer. For example, if the magnitude of the oscillation exceeds a certain value, such as 50 μm, then the oscillation may generate an unacceptable degradation in image quality. The controller 228 generates a visual or audible alert to inform an operator that the run out of the apex roller 219 exceeds a predetermined tolerance range. The apex roller 219 is subsequently serviced or replaced to eliminate the excessive run out and media web oscillation.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art, which are also intended to be encompassed by the following claims.

We claim:

1. An inkjet printer comprising:

a media transport configured to move a media web through a print zone in a process direction;

a printhead positioned in the print zone and having a plurality of inkjets configured to eject ink drops onto the media web;

a plurality of optical detectors configured in a cross-process direction across the image receiving member, each optical detector in the plurality of optical detectors being configured to detect light reflected from the image receiving member; and a controller operatively connected to the printhead and the plurality of optical detectors, the controller being configured to:

operate the plurality of inkjets in the printhead to form an array of marks on the media web, each inkjet in the plurality of inkjets forming one series of marks in the array of marks extending in the process direction and the array of marks including a plurality of series of marks extending in the cross-process direction, each inkjet in the plurality of inkjets commencing formation of a corresponding series of marks in the plurality of series of marks at a time that is different from a time at which at least one other inkjet commences formation of another one of the plurality of series of marks;

generate image data corresponding to the array of marks with the plurality of optical detectors;

identify a cross-process direction location of each mark in the array of marks with reference to the image data;

identify a relationship between relative cross-process locations of successive marks in each series of marks in the plurality of series of marks in the image data with reference to predetermined times at which each mark in each series of marks was formed;

generate an estimate of a cross-process direction movement of the media web over time with reference to the relationship for each series of marks in the plurality of series of marks in the image data;

generate a corrected cross-process direction location for each of the series of marks in the array of marks with reference to the identified cross-process location of each mark and an estimated cross-process direction offset of the media web at a time at which each mark was formed with reference to the estimate of cross-process direction movement of the media web;

identify with reference to the corrected cross-process direction location of each mark in the array of marks a cross-process direction distance between a first series of marks and at least one other series of marks; and identify a difference between an angular orientation of the printhead and the cross-process direction with reference to the identified cross-process direction distance.

2. The inkjet printer of claim 1 further comprising:

an actuator operatively coupled to the printhead and configured to rotate the printhead about an axis that is perpendicular to as surface of the media web; and the controller being operatively connected to the actuator and further configured to:

operate the actuator to rotate the printhead into alignment with the cross-process direction with reference to the identified difference between the angular orientation of the printhead and the cross-process direction.

3. The inkjet printer of claim 1, the controller being further configured to:

identify a relative change in a cross-process direction position of the media web during formation of each series of marks in the plurality of series of marks in the array of marks with reference to the identified relationship for each series of marks in the plurality of series of marks;

identify a change in the cross-process direction position of the media web during formation of the array of marks beginning from a first time when a first series of marks in the plurality of series of marks is formed on the media web to a last time when a last series of marks in the plurality of series of marks is formed on the media web with reference to the identified relative change in the cross-process direction position of the media web for each of the identified relationships; and generate the estimate of the movement of the media web over time with a function that estimates the identified change in the cross-process direction position of the media web during formation of the array of marks.

4. The inkjet printer of claim 3, the function being a third order polynomial function.

5. The inkjet printer of claim 1, the controller being further configured to:

operate a first inkjet in the plurality of inkjets to form a first series of marks in the array of marks on the media web, the first inkjet beginning to form the first series of marks at a first time; and operate a second inkjet in the plurality of inkjets to form a second series of marks in the array of marks, the second inkjet beginning to form the second series of marks at a second time that is later than the first time and before the first inkjet completes formation of the first series of marks.

6. The inkjet printer of claim 1 the controller being further configured to:

identify an average cross-process direction location of each series of marks in the plurality of series of marks with reference to the corrected cross-process direction location of each mark; and identify a cross-process direction distance between two inkjets in the printhead with reference to the identified average cross-process direction location of two difference series of marks in the plurality of series of marks formed by the two inkjets; and identify the difference between the angular orientation of the printhead and the cross-process direction with reference to the identified cross-process direction distance between the two inkjets and a predetermined cross-process direction distance between the two inkjets when the printhead is aligned in the cross-process direction.

* * * * *